US008038088B2

(12) United States Patent
Pallmann

(10) Patent No.: US 8,038,088 B2
(45) Date of Patent: Oct. 18, 2011

(54) COMMINUTING DEVICE WITH COUNTER-ROTATING ROTORS

(75) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 3 days.

(21) Appl. No.: 12/359,977

(22) Filed: Jan. 26, 2009

(65) Prior Publication Data

US 2009/0189004 A1 Jul. 30, 2009

(30) Foreign Application Priority Data

Jan. 24, 2008 (DE) ..... 10 2008 005 941

(51) Int. Cl.
*B02C 18/16* (2006.01)

(52) U.S. Cl. ..... 241/236; 241/294

(58) Field of Classification Search ..... 241/236, 241/294, 194

See application file for complete search history.

(56) References Cited

U.S. PATENT DOCUMENTS 4,684,071 A 8/1987 Dicky
5,100,070 A * 3/1992 Montgomery, Sr. ..... 241/294
5,680,999 A * 10/1997 Wada ..... 241/236
5,730,375 A 3/1998 Cranfill et al.
6,439,486 B1 * 8/2002 Nitta et al. ..... 241/29
6,481,655 B1 * 11/2002 Feigel, Jr. ..... 241/294
2003/0122006 A1 7/2003 Dubech et al.

FOREIGN PATENT DOCUMENTS

EP 1289 663 B1 1/2007

* cited by examiner

*Primary Examiner* — Mark Rosenbaum
(74) *Attorney, Agent, or Firm* — Muncy, Geissler, Olds & Lowe, PLLC

(57) ABSTRACT

A device for comminuting feedstock is provided that includes a cutting tool with a first rotor and at least one second rotor, each of which rotate around their longitudinal axis with an opposite rotation direction. Each rotor is provided with a number of cutting discs, which are arranged at an axial distance to one another. In this case, the cutting discs of the first rotor are located on gaps and with radial overlapping relative to the cutting discs of the second rotor. The cutting discs along their circumference have support surfaces for accepting cutting tools, whose cutting edges move past one another over the course of the rotation of rotors with the formation of a cutting clearance. For the positionally precise fixation of the cutting tool on the cutting discs, a positive fit is formed between the cutting tools and cutting discs, a positive fit groove running in the plane of the cutting disc is arranged in the common contact area, the groove in which at least one positive fit strip engages.

14 Claims, 8 Drawing Sheets

COMMINUTING DEVICE WITH COUNTER-ROTATING ROTORS

This nonprovisional application claims priority under 35 U.S.C. §119(a) to German Patent Application No. 10 2008 005 941.2, which was filed in Germany on Jan. 24, 2008, and which is herein incorporated by reference.

BACKGROUND OF THE INVENTION

1. Field of the Invention

The invention relates to a device for comminuting feedstock.

2. Description of the Background Art

The comminuting of feedstock is a central component of mechanical process engineering in which a starting material is divided by separation into smaller parts. In this case, the feedstock is altered in its size, form, or composition in view of its later use. Separation methods suitable for this provide for comminuting by means of tearing, beating, rubbing, grinding, or cutting. An example is the preparation of waste products, in which size reduction of the feed material is a requirement for processing in subsequent processing stations or in which separation into various components, present in the feedstock, occurs simultaneously during comminuting.

It is known for comminuting by means of cutting to move the cutting edges of cutting tools past one another to execute an effective motion. Apart from the type of feedstock and its insertion during the cutting process, the cutting geometry determined by the machine structure as well is a major determining factor for the cutting process. To achieve a clean cut, it is necessary in particular that the active cutting edges of the cutting tools slide past one another while maintaining an optimal blade clearance, which depends on the type of feedstock. With an increase in the distance between the jointly acting cutting edges, the effectiveness of the cutting process declines, because part of the energy to be applied for grinding, tearing, or crushing the feedstock is used up. As a result, increased mechanical stress arises, which accelerates signs of wear, reduces operating reliability, and not least increases energy consumption. Maintaining an optimal cutting geometry is very important therefore.

U.S. Pat. No. 4,684,071 discloses a device for comminuting used tires, in which a vehicle tire is divided by counter-rotating cutting rotors. The cutting rotors including cutting discs which are arranged on a shaft at an axial distance and are populated at their circumference with cutting tools, whereby the cutting discs of the one rotor engage with a smaller radial overcutting into the gaps of the other cutting rotor. Because the cutting tools are exposed to great mechanical stress during operation and have a correspondingly great wear, the cutting tools are affixed detachably to the cutting discs, so that they can be replaced by new or resharpened tools.

Two possible ways of affixing the cutting tools to the cutting discs are disclosed in U.S. Pat. No. 5,730,375. It is possible, on the one hand, to form the circumferential surface of each cutting disc in the shape of a polygon, which results in a planar support surface for the cutting tools. The cutting tools are bolted down by means of radially acting bolts, which are accessible from the top side of the cutting tools and extend into the circumferential area of the cutting discs, whereby the heads of the bolts come to lie within corresponding recesses. Because during damage to cutting tools due to rough comminuting operation the support surface for the cutting tools and the tapped holes in the cutting discs become damaged and must be repaired when the cutting tools are changed, another embodiment, depicted in U.S. Pat. No. 5,730,375, comprises affixing the cutting tools with the interconnection of a bearing plate on the outer circumference of the cutting discs. This has the advantage that in the case of damage only the bearing plates need to be replaced but the entire support surface of the cutting discs need not be resharpened. In addition, to take up the fixing bolts bushings are provided, which have both an inside and outside thread and are screwed into radial holes in the disc rotor. With their inside threads, the bushings in turn take up the fixing bolts. If an inside thread is damaged, the threaded bushing can be replaced as a whole unit without having to work on the disc rotor itself.

During operation of comminuting devices of this type, large axial forces arise, which are passed via the cutting tools to the cutting discs. These forces must be absorbed by the fixing bolts, which are stressed thereby by shearing and bending. Because the load bearing capacity of each bolt is limited, the removal of the total load requires a relatively large number of fixing bolts, which, when the cutting tool is changed, entail a correspondingly large amount of work because of their loosening and retightening.

Another factor is that the positioning of the cutting tools on the cutting discs is carried out with the fixing bolts. As a result of the play between the cutting tool and the fixing bolt, large tolerances arise during the setting of the blade clearance, which are an obstacle to maintaining a precise cutting geometry and entail the previously described negative effects on the cutting process.

Another factor is that based on geometric circumstances and static requirements, the fixing bolts may be disposed only with maintenance of a minimum distance to the transverse edge of the cutting tools. The arising leverages with a non-uniform load application during the comminuting process lead to a nonoptimal load removal, which must be considered in dimensioning the fixing bolts.

To find a remedy here at least in part, European Pat. No. EP 1 289 663 A1, which corresponds to U.S. Publication No. 20030122006, and which discloses a rotor for a generic comminuting device, in which the cutting tools are affixed laterally to a tool holder by means of screws, optionally with the interconnection of compensating plates. The thus arising cutting unit comprising tool holder and cutting tools is affixed by radially acting screws at the outer circumference of a cutting blade, whereby positioning pins are provided for exact positioning of the cutting unit. As a result, the positioning accuracy of the tool holder relative to the cutting disc is in fact improved, but dimensional inaccuracies are again introduced into the system by the screwing of the cutting tools to the tool holder, optionally with inserted distance plates; these in turn undo this advantage.

In view of the static load removal behavior, in this type of construction, axial stress is introduced via the fixing screws and the positioning pins into the cutting discs with a load removal cross section limited by the number and diameters of the screws or pins. In addition, here as well no optimal force transfer from the cutting tool to the cutting disc is possible, because the positioning pins due to construction must also maintain a minimum distance to the transverse edges of the tool holder.

SUMMARY OF THE INVENTION

It is therefore an object of the invention to provide a device in which the cutting process is carried out with the greatest precision possible with simultaneous improvement of the load introduction into the cutting discs and with minimizing of the effort for changing the cutting tools.

A principle of the invention is the separation of the functional units for secure and positionally accurate fixation of the cutting tools on the cutting discs. In this case, a splitting of functions occurs, on the one hand, in the clamping down and securing of the cutting tools on the cutting disc, and, on the other, in the securing of the snug fit of the cutting tools in the predefined desired position on the cutting disc.

The clamping down of the cutting tool according to the invention is carried out with radially acting bolts. Experience has shown that bolts are not up to the rough comminuting operation within generic devices and are therefore frequently bent or otherwise damaged, so that loosening of bolts and thereby replacement of the comminuting tools are possible only with great effort, and the bolts usually need to be replaced by new ones.

Because in a device according to an embodiment of the invention the fixing bolts are only stressed during pulling and are therefore free of transverse force and momentum stresses, their axial load-bearing behavior can be fully utilized.

The other functional units to secure the snug fit of the cutting tool are used primarily to secure the position of the cutting tool in the axial direction to assure the optimal cutting clearance and thereby the optimal cutting geometry. By placing a positive fit groove on one side and a positive fit strip on the other side, in comparison with known devices, relatively large areas for absorbing the load arise, which also permit the introduction of large forces securely into the rotor without damage to the comminuting tools.

For the advantageous case that the positive fit groove and the positive fit strip extend over the entire length of the bottom side of the cutting tool, very favorable starting geometric conditions arise to keep a secure position also with a nonuniform load application.

According to an embodiment of the invention, the positive fit groove has a cross section that narrows trapezoidally toward the bottom of the positive fit groove. This facilitates, on the one hand, the setting of the cutting tool on the cutting disc. On the other hand, loosening of the cutting tool is promoted by this, because jamming or wedging of the positive fit strip in the positive fit groove is effectively prevented.

The positive fit groove and the positive fit strip can extend over the entire length of the bottom side of the cutting tool and/or the support surface of the cutting disc. This does not rule out, however, that the positive fit groove or at least the positive fit strip may also be discontinuous. This type of embodiment of the invention advantageously has positive fit strips that engage in the positive fit groove sectionally at least in the end regions.

Another embodiment of the invention provides that the longitudinal sides of the cutting tools are made in such a way that with optional wear plates at the side surfaces of the cutting disc they effect their fixation in the desired position. Thus, the wear plates without further action are simultaneously attached to the cutting discs with the assembly of the cutting tools.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
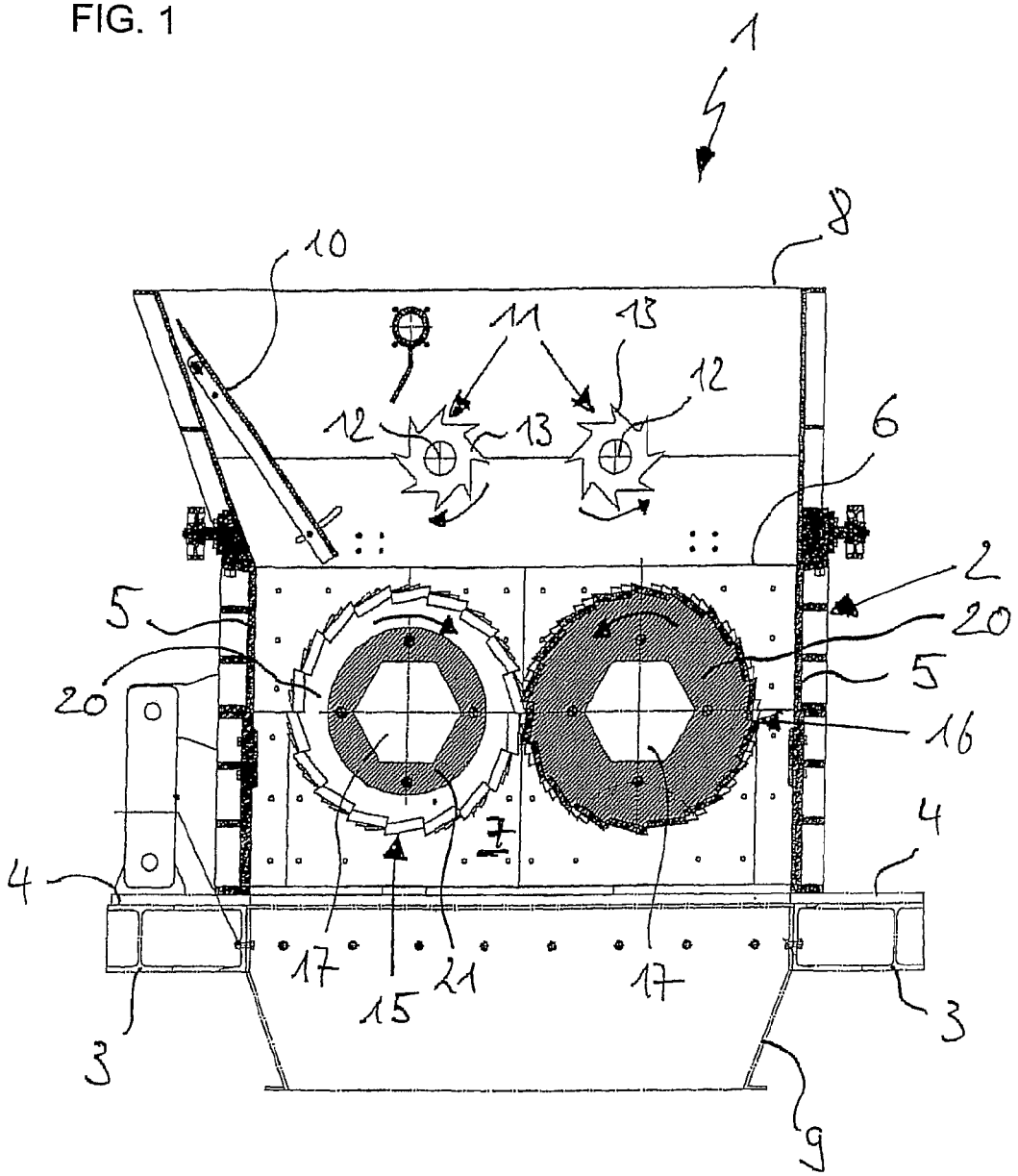
FIG. 1 shows a vertical section through a device of the invention along the line I-I depicted in FIG. 2.
Figure 2:
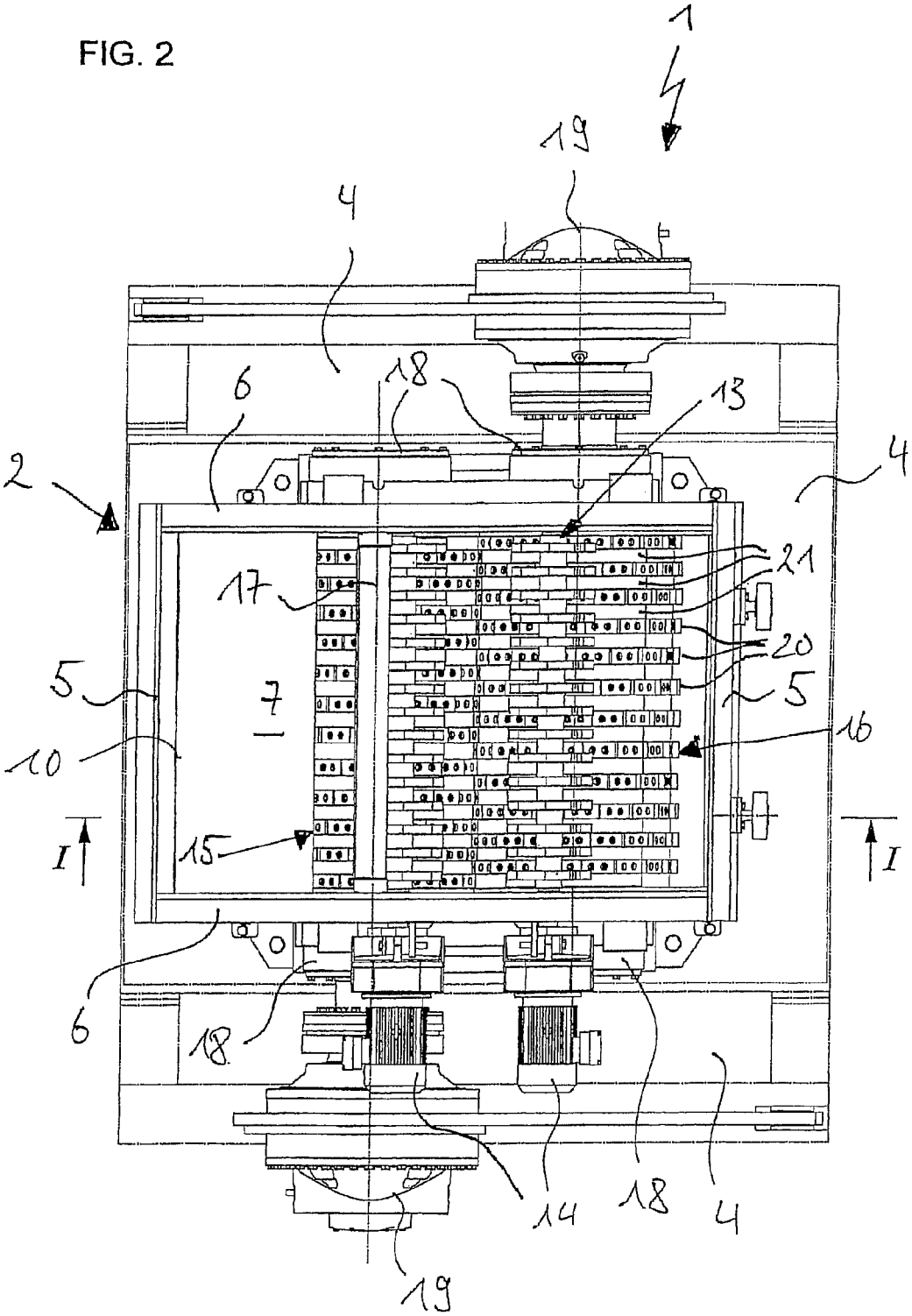
FIG. 2 shows a top plan view of the device depicted in FIG. 1.

FIGS. 1 to 4 show the general structure of a device of the invention in the form of a double shaft shredder 1, which is suitable, for example, for the pre-comminuting of used tires, but also for the preparation of electronic waste and other materials. Double shaft shredder 1 has a rectangular housing 2, which is open upward and downward and with its cross walls 5 and longitudinal walls 6 encloses a working space 7. Housing 2 rests on a supporting frame 3, whose top side is covered by cover plate 4 around housing 2, to form in this manner a platform for other machine components.

A funnel-like material outlet 9, through which the sufficiently comminuted material is discharged from double shaft shredder 1, is connected to the lower opening of housing 2. Feed hopper 8, which is flush with cross walls 5 and longitudinal walls 6 and over which the feedstock is loaded into double shaft shredder 1, is attached to the upper opening of housing 2. Internals joining longitudinal walls 6 extend within feed hopper 8 for material charging. These include, on the one hand, a chute 10, adjustable in inclination, and, on the other, of conveying rollers 11, whose shafts 12 have star-shaped gripping wheels 13 and which are caused to rotate oppositely by electric drives 14 on the outside of the one longitudinal wall 6.

The cutting tool, which performs the comminuting of the feedstock, is located in cutting chamber 7. The cutting tool comprises substantially two rotors 15 and 16, which are disposed at a predefined distance, axis-parallel to one another, and with an opposite rotation direction between longitudinal walls 6. The structure of rotors 15 and 16 is a mirror image each with a drive shaft 17, which is supported rotatable in bearings 18 disposed on the outside of longitudinal wall 6. In each case, an end of drive shaft 17 is coupled to a hydraulic rotary drive 19, which causes the rotation movement of each rotor 15 and 16 in the rotation direction shown by arrows.

Figure 3:
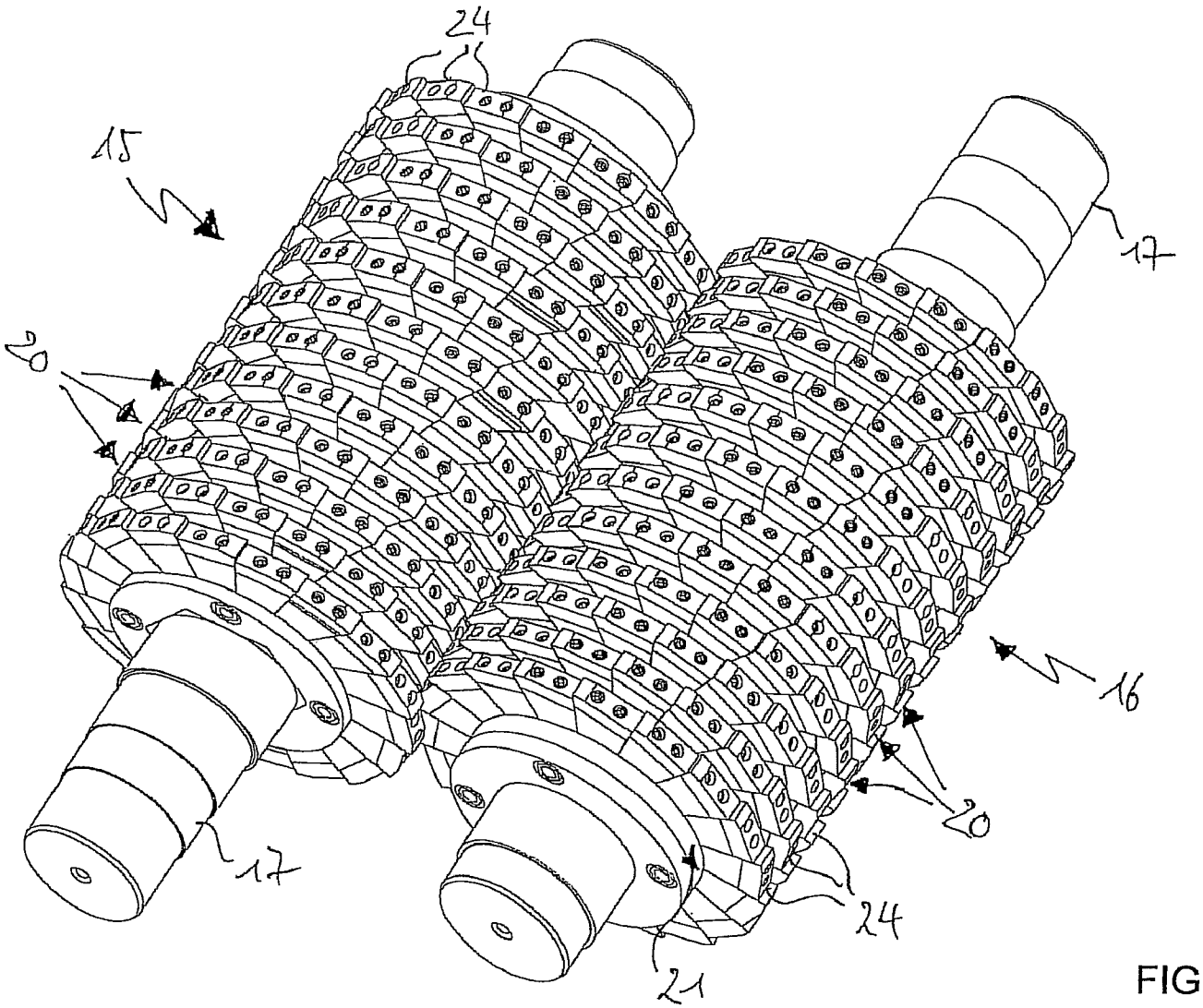
FIG. 3 shows an oblique view of the cutting tool of the device depicted in FIGS. 1 and 2.
Figure 4:
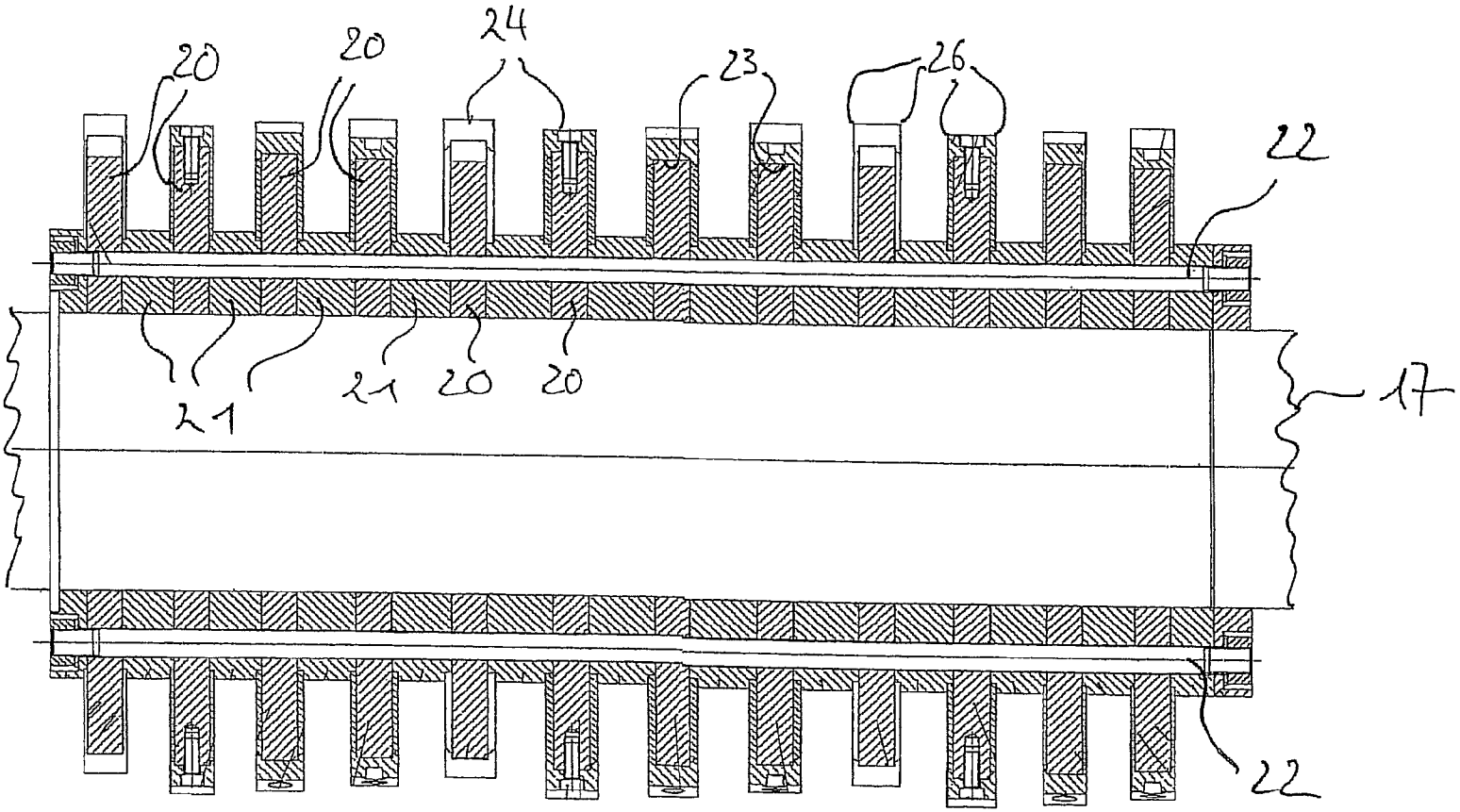
FIG. 4 shows a longitudinal section through the rotor shown in FIG. 3.

As is evident primarily from FIGS. 3 and 4, rotors 15 and 16 have a plurality of cutting discs 20 and spacer discs 21, which are seated alternately on drive shaft 17. The drive force is transferred via a positive fit between cutting discs 20 or spacer discs 21 and drive shafts 17 (FIG. 1). Axis-parallel bolts 22 clamp cutting discs 20 and spacer discs 21 together.

Cutting discs 20, which have a much larger diameter compared with spacer discs 21, have a polygonal profile at their circumference, as a result of which support surfaces 23 with an approximate tangential course arise, which form the seat for cutting tools 24. The specific design of support surface 23 will be dealt with in greater detail in the description of FIGS. 5*a* to 8*b*.

The relative position of rotors 15 and 16 to one another is such that due to an axial offset by the thickness of a spacer disc 21, in each case a spacer disc 21 and a cutting disc 20 lie opposite each other in the radial direction. In the radial direction, the distance between axes of both shafts 17 of rotors 15 and 16 is selected so that a radial overlapping of cutting tools 23 is assured in each position of cutting discs 20; i.e., cutting discs 20, equipped with cutting tools 23, of both rotors 15 and 16 mesh together.

In this way, the longitudinal edges of cutting tools 24 form cutting edges 26, which during the cutting process are moved past one another over the course of the opposite rotation of rotors 15 and 16. In this regard, the structure-related axial distance between two jointly acting cutting edges 26 defines a blade clearance 27 (FIG. 5*a*), whose size significantly determines the quality of the cutting process. Depending on the type of feedstock and other parameters, there is an optimal size for blade clearance 27 in each case, whereby deviations from this size cause the cutting process to degrade considerably. A precise positioning of cutting edges 26 relative to one another is very important for this reason.

FIGS. 5*a* to 8*b* show structural solutions for the positionally precise attachment of cutting tools 24 to cutting discs 20. The embodiment shown in FIGS. 5*a* and *b* is characterized by a positive fit strip 28, which extends centrally over the entire length of support surface 23 at the outer circumference of cutting disc 20. Working together with positive fit strip 28 is a cutting tool 24, which has a complementary positive fit groove 31 on its bottom side 30 facing support surface 23. Axial bearing surfaces on which cutting tool 24 braces during the action of axial forces against cutting disc 20 arise in this way by means of the mutually assigned side surfaces of positive fit strip 28 and positive fit groove 31.

Figure 5B:
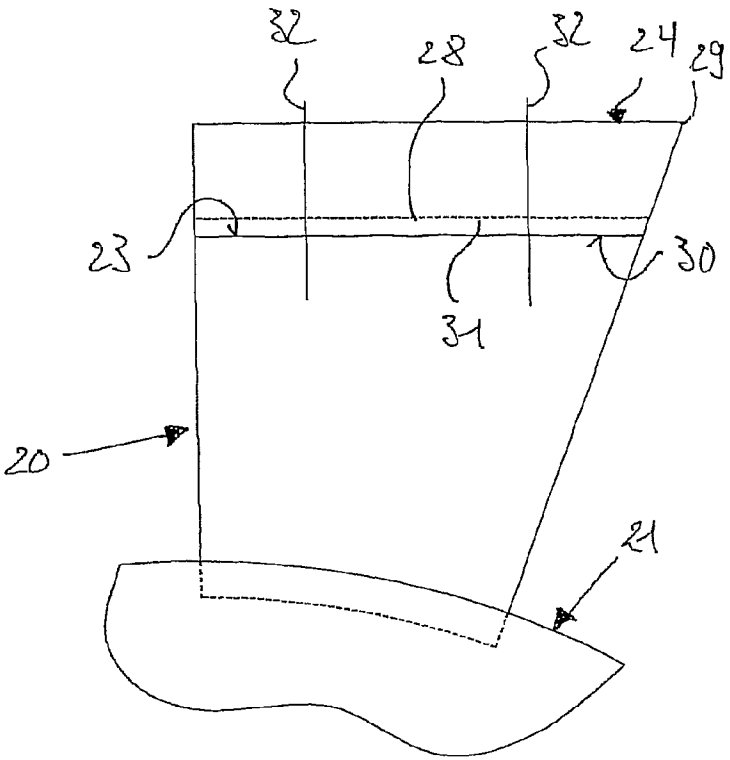
FIGS. 5*a* and *b* show a first embodiment of the attachment of a cutting tool to a cutting disc in cross section and in the associated partial view.
Figure 5A:
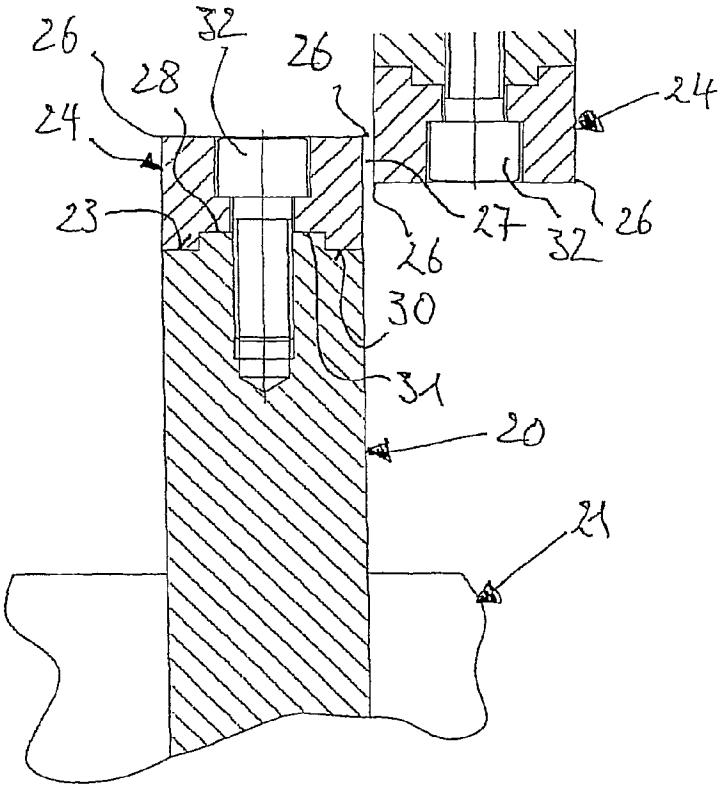

FIGS. 5*a* and *b* relate to a first embodiment of the invention and thereby show the subarea, important for the invention, of a cutting disc 20. The support area 23 is evident over whose entire length a positive fit strip 28 projects in the middle.

Cutting tool 24 substantially has a bar-shaped form and is fashioned of solid metal, preferably of hardened steel. The front end in the rotation direction is beveled, so that the top edge forms a grip tooth 29 for the secure drawing in of the feedstock. The lateral longitudinal edges at the top side of cutting tool 24 form cutting edges 26 effective for the cutting process.

A positive fit groove 31, which is made complementary to positive fit strip 28, runs in the center and over the entire length on the bottom side 30 of cutting tool 24. When cutting tool 24 is placed on cutting disc 20, a positionally precise seating therefore results by itself without further action and attentiveness by operating personnel.

Two fixing bolts 32 (indicated only by axes in FIG. 5*b*), which extend into cutting disc 20 radially through cutting tool 24, are used to fix cutting tool 24 in its desired position on cutting disc 20. The head of fixing bolts 32 is thereby countersunk in recesses originating on the top side of cutting tool 24.

During operation of a device of the invention, a system of load removal thereby results, in which axial forces are taken up via the entire sides of positive fit strip 28 or positive fit groove 31 over their entire surface and transferred. Because there is a load removal surface over the entire length of cutting tool 24 thereby, greater forces overall can be absorbed and an optimal load removal behavior also results with nonuniform load applications.

In contrast, radial lifting forces are absorbed by bolts 32 alone, which tighten cutting tool 24 against cutting disc 20. The strict separation of load removal of axial and radial forces successfully protects bolts 32 from a shearing force effect and the associated bending moment.

The attachment of cutting tools 24 to cutting discs 20 according to the invention therefore simultaneously enables a precise positioning of cutting edges 26, optimal force transfer from cutting tools 24 to cutting disc 20, and protection of bolts 32 from bending stress. As a result, a precise cutting geometry with high operating reliability is assured.

Figure 6B:
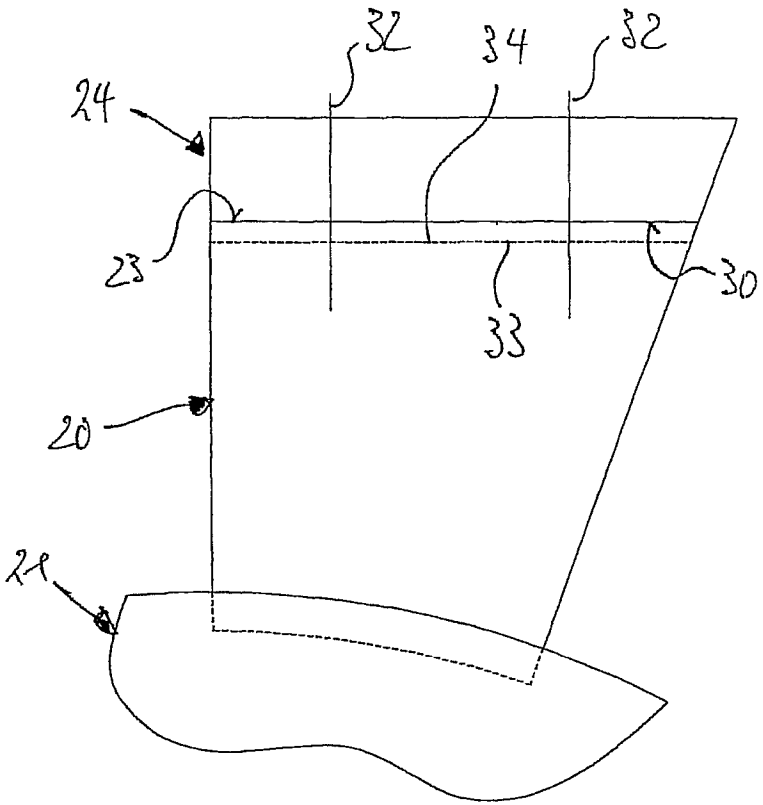
FIGS. 6*a* and *b* show a second embodiment of the attachment of a cutting tool to a cutting disc in cross section and in the associated partial view.
Figure 6A:
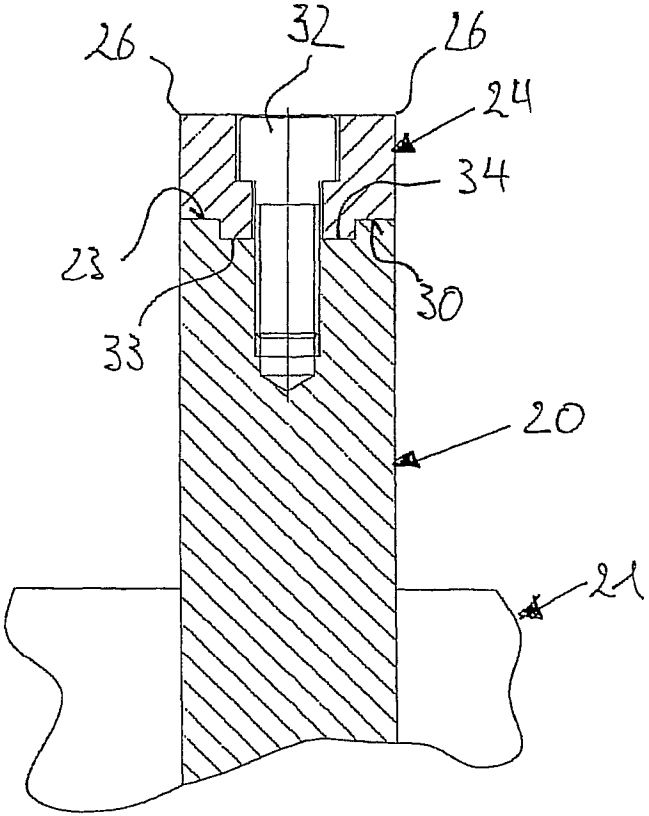

FIGS. 6*a* and *b* show an embodiment of the invention, which corresponds in large parts to those described for FIGS. 5*a* and *b*, so that the same reference characters are used for the same elements and what has been stated there corresponds accordingly.

There are differences only in the area of the positive fit between cutting tool 24 and cutting disc 20 for the precise positioning and removal of axial forces. For this purpose, positive fit strip 33 is arranged on the bottom side 30 of cutting tool 24 and engages in a positive fit groove 34 in support area 23 of cutting disc 20.

FIGS. 7*a* to 8*b* relate to embodiments of the invention, which are particularly suitable in relation to wear protection for the face sides of cutting discs 20. In the case of abrasive feedstock, circular surface 35 between spacer disc 21 and the outer circumference of cutting disc 20 is at risk for wear, for which reason it is already known to protect cutting disc 20 in the area of circular surface 35 by means of wear-resistant plates. The embodiments shown in FIGS. 7*a* to 8*b* combine in a special way the arrangement of cutting tool 24 on cutting disc 20 with simultaneous fixation of wear protection.

Figure 7B:
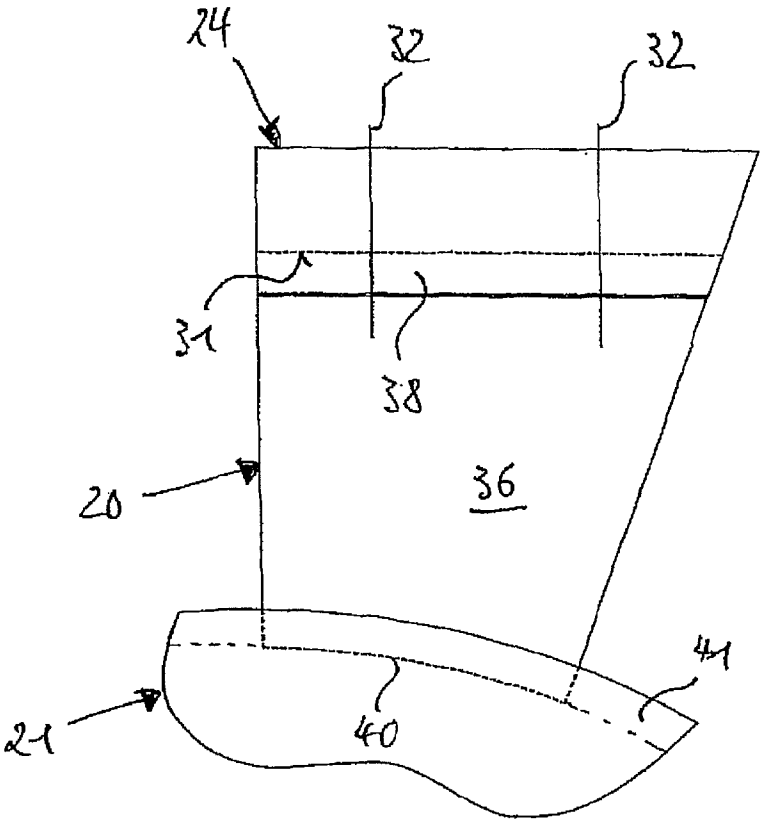
FIGS. 7*a* and *b* show a third embodiment of the attachment of a cutting tool to a cutting disc in cross section and in the associated partial view.
Figure 7A:
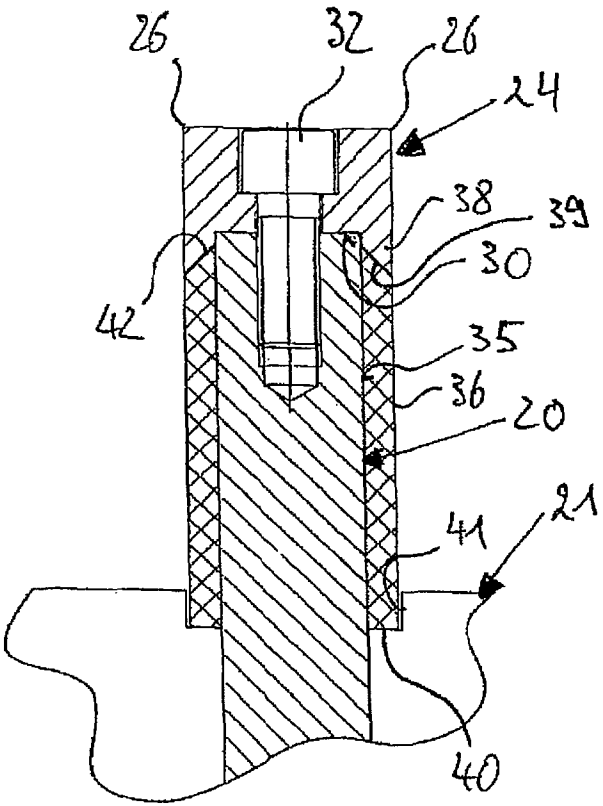

An embodiment is shown for this purpose in FIGS. 7*a* and *b* in which cutting tools 24 have a bilateral axial overhang over cutting disc 20 and have a longitudinal base 38 projecting from the bottom side 30 and parallel to surfaces 35. Bottom side 30 in this way forms a trough-like slot, in which cutting disc 20 comes to lie with its outer circumference with an accurate fit. Base 38 with its interior sides thus forms axially acting force transfer areas to cutting disc 20, which assure an accurately fitting seat of cutting tools 24 on cutting discs 20.

In addition, top sides 39 of base 38 are inclined inward, preferably at an angle of 45°, so that undercuts result, which with cutting disc 20 form spandrel-shaped slots for fixation of the wear protection.

The wear protection is formed by approximately trapezoidal plates 36, whose lower curved edge 40 comes to lie in hollowed-out areas 41 in the edge region of spacer discs 21. Upper edge 42 has an inclination complementary to top side 39 of base 38, so that the pointed edge engages in the ring-shaped undercut of base 38 and is held in the axial direction. After placement and attachment of cutting tool 24, a simultaneous attachment of plates 36 is thereby achieved.

Figure 8B:
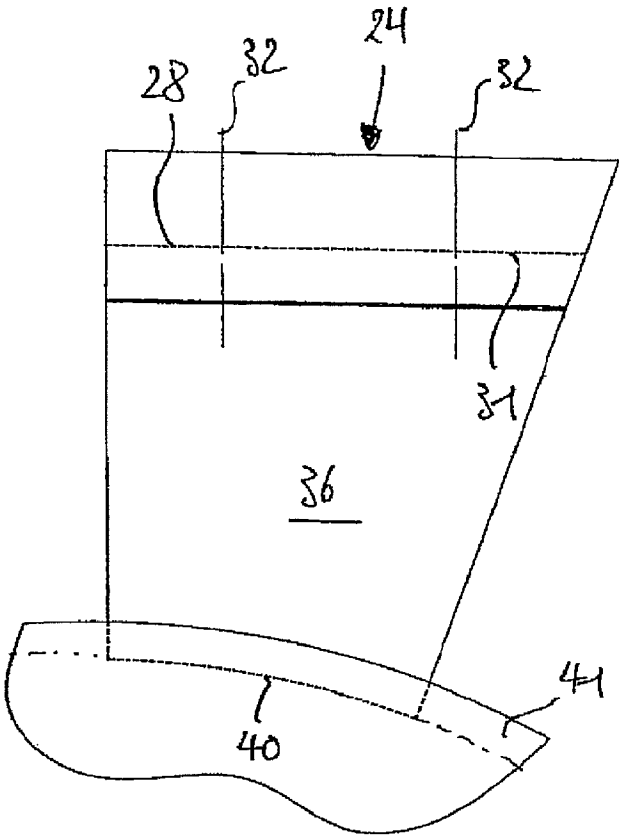
FIGS. 8*a* and *b* show a fourth embodiment of the attachment of a cutting tool to a cutting disc in cross section and in the associated partial view.
Figure 8A:
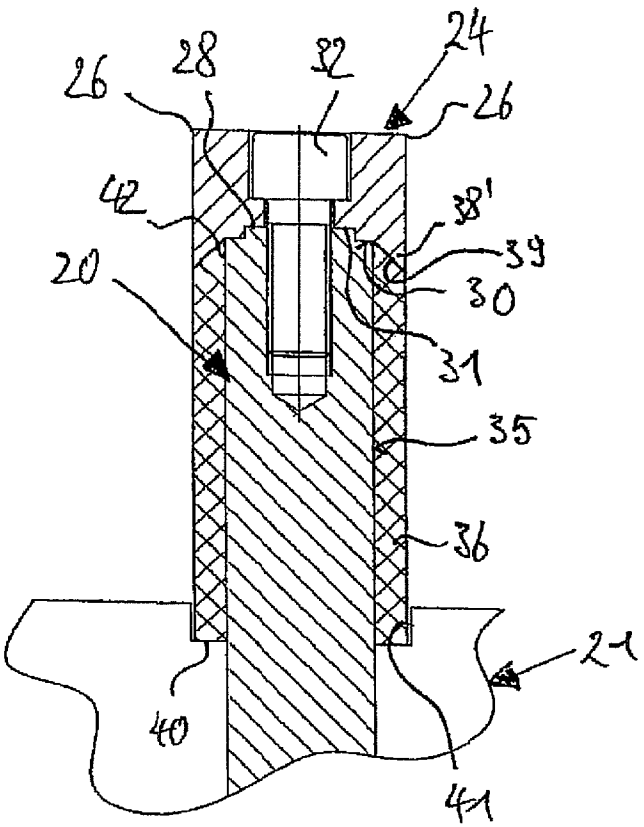

FIGS. 8*a* and *b* relate to an embodiment of the invention, which combines together the features of the examples shown in FIGS. 5*a, b* and 7*a, b* with the advantage that base 38' is used only for fixation of plate 36 and therefore may be formed structurally thinner.

Support area 23 of cutting disc 20 corresponds to that described in FIGS. 5*a* and *b* with a positive fit strip 28, which acts together with a positive fit groove 31 in the bottom side 30 of cutting tool 24. In addition, cutting tool 24 is made broader than cutting disc 20, as a result of which a longitudinal base 38' is formed with the overhang.

In comparison with the embodiment in FIG. 7, the height of base 29' is reduced, whereby top side 39 flush with its inner edge, therefore without a step, merges into bottom side 30, whereas the pointed edge again forms an undercut. The attachment of plate 36 then occurs as already described in FIGS. 7*a* and *b*.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting feedstock, the device comprising:

a cutting tool;

a first rotor; and at least one second rotor, the first rotor and the second rotor each being configured to rotate around a respective longitudinal axis with an opposite rotation direction than the other, wherein each rotor has a plurality of cutting discs that are arranged at an axial distance to one another, wherein the cutting discs of the first rotor are provided on gaps and with radial overlapping relative to the cutting discs of the second rotor, wherein the cutting discs, along their circumference, have support surfaces for accepting cutting tools, whose cutting edges move past one another over the course of the rotation of rotors thereby forming a cutting clearance, wherein to create a positive fit between the cutting tool and cutting disc, a positive fit groove, running in a plane of the cutting disc, is arranged to create a common contact surface between the cutting tool and cutting disc that varies in a direction parallel to an axis of rotation and perpendicular to the plane of the cutting disc, wherein at least one positive fit strip engages the positive fit groove, and wherein a width of the cutting tool is greater than the thickness of the cutting disc and an overhang of the cutting tool is inclined over the side surfaces of the cutting disc with the formation of an undercut to the cutting disc.

2. The device according to claim 1, wherein the positive fit groove is arranged in the support surface of the cutting disc and the positive fit strip in the bottom side of the cutting tool.

3. The device according to claim 1, wherein the positive fit groove is arranged in the bottom side of the cutting tool and the positive fit strip in the support surface of the cutting disc.

4. The device according to claim 1, wherein the width of the cutting tool is greater than the thickness of the cutting disc and base-shaped formations are formed at an overhang over the side surfaces of the cutting disc, the formations forming the positive fit groove into which the cutting disc integrates with its entire thickness as a positive fit strip.

5. The device according to claim 4, wherein a top side of the base-shaped formations is inclined toward the cutting disc with the formation of an undercut.

6. The device according to claim 1, wherein free side surfaces of the cutting disc are covered with wear plates, whose top edge is formed to form a positive fit complementary to the undercut.

7. The device according to claim 6, wherein the wear plates are arranged with their bottom edge in complementary recesses in the rotor.

8. The device according to claim 6, wherein the wear plates are arranged with their bottom edge in complementary recesses in the spacer discs.

9. The device according to any claim 1, wherein the positive fit groove has a cross section that narrows trapezoidally toward the bottom of the positive fit groove.

10. The device according to claim 1, wherein the positive fit groove and the positive fit strip extend over the entire length of the support surface.

11. The device according to claim 1, wherein the positive fit groove extends over the entire length of the support surface and wherein the positive fit strip is discontinuous so that only sections of the positive fit strip engage in the positive fit groove.

12. The device according to claim 11, wherein the positive fit strip is discontinuous in the middle area.

13. The device according to claim 1, wherein the cutting tool further comprising:

a bottom side designated for attachment to the device and having the complimentary positive fit groove or the at least one positive fit strip to engage the device.

14. A cutting tool for attachment to a cutting device having a plurality of cutting discs with support surfaces along their circumference for accepting cutting tools, the support surfaces including a positive fit groove to create a positive fit between the cutting tool and cutting disc, the cutting tool comprising:

a complimentary positive fit groove or a positive fit strip configured to engage the positive fit groove of one of the cutting discs by varying a bottom side of the cutting tool in a direction parallel to an axis of rotation and perpendicular to a plane of the cutting disc wherein a width of the cutting tool is configured to be greater than a thickness of the cutting disc and an overhang of the cutting tool is configured to be inclined over side surfaces of the cutting disc with, the formation of an undercut to the cutting disc.

* * * * *